US011122947B2

(12) United States Patent
Caswell et al.

(10) Patent No.: US 11,122,947 B2
(45) Date of Patent: Sep. 21, 2021

(54) BROOM-STYLE CLEANING APPLIANCE

(71) Applicant: Enhance Product Development, Inc., Minneapolis, MN (US)

(72) Inventors: Ty Joseph Caswell, Zimmerman, MN (US); Trevor Lambert, Brooklyn Park, MN (US); Thomas Grimm, Stillwater, MN (US)

(73) Assignee: ENHANCE PRODUCT DEVELOPMENT, INC, Minneapolis, MN (US)

( * ) Notice: Subject to any disclaimer, the term of this patent is extended or adjusted under 35 U.S.C. 154(b) by 347 days.

(21) Appl. No.: 15/922,620

(22) Filed: Mar. 15, 2018

(65) Prior Publication Data

US 2018/0271268 A1 Sep. 27, 2018

Related U.S. Application Data

(60) Provisional application No. 62/474,805, filed on Mar. 22, 2017.

(51) Int. Cl.

| | |
|---|---|
| ***A47L 9/06*** | (2006.01) |
| ***A47L 5/24*** | (2006.01) |
| *A46B 15/00* | (2006.01) |
| *A47L 7/00* | (2006.01) |

(52) U.S. Cl.

CPC ..... *A47L 9/06* (2013.01); *A47L 5/24* (2013.01); *A46B 15/0053* (2013.01); *A46B 2200/302* (2013.01); *A47L 7/0014* (2013.01)

(58) Field of Classification Search

CPC ..... A47L 5/24; A47L 9/06; A46B 15/0053; A46B 2200/302

See application file for complete search history.

(56) References Cited

U.S. PATENT DOCUMENTS

| | | | | |
|---|---|---|---|---|
| 5,432,976 | A * | 7/1995 | Alazet | A46B 15/00 15/344 |
| 5,617,610 | A * | 4/1997 | Dearaujo | A47L 5/28 15/328 |
| 6,029,311 | A | 2/2000 | Scanni et al. | |
| 6,536,075 | B1 * | 3/2003 | Bonnet | A47L 5/24 15/344 |
| 7,631,387 | B2 * | 12/2009 | Sclafani | A46B 7/10 15/41.1 |
| 7,673,371 | B1 | 3/2010 | Shahbaz | |
| 8,015,662 | B2 * | 9/2011 | Rosenzweig | A46B 15/0055 15/368 |

* cited by examiner

*Primary Examiner* — Bryan R Muller
(74) *Attorney, Agent, or Firm* — Jose W. Jimenez; Jimenez Law Firm

(57) ABSTRACT

There is described herein a broom-style cleaning appliance with built in vacuum assembly that can be activated via an elongate nozzle member located adjacent a bundle of cleaning bristles to eliminate the need for a dustpan. Once the vacuum module is activated the debris is collected in a collection chamber housed above or adjacent to the cleaning bristles or elements.

9 Claims, 18 Drawing Sheets

BROOM-STYLE CLEANING APPLIANCE

CLAIM OF PRIORITY

This application claims priority to and the benefit of a U.S. Provisional Application with Ser. No. 62/474,805, filed on Mar. 22, 2017, which is incorporated herein by reference in its entirety.

FIELD OF THE INVENTION

The invention relates generally to a broom with built in accessory to eliminate the need for a dustpan.

BACKGROUND

Currently there are a number of solutions for sweeping dust and dirt in the home or in the garage. One of these solutions is to use a typical kitchen broom and dust pan, but this solution fails to meet the needs of the market because there is always some debris left when using a broom and a dustpan. Another solution attempts to use currently available broom handles with an added vacuum, but this solution is similarly unable to meet the needs of the market because the solutions use a significantly reduced size bristle arrangement that no longer 'sweep' properly. This arrangement also uses too large of a vacuum intake opening (manifold/nozzle) that does the opposite of concentrating suction but instead spreads the suction over too large an area thereby lacking enough suction to lift any debris. Therefore, there is a need in the market for a device that addresses these product shortcomings.

SUMMARY

It would be advantageous to have an apparatus such as a broom assembly with an integrated vacuum collection system to fulfill the needs of the market. Furthermore, it would be advantageous to have a broom with a vacuum unit that turns on when an articulating vacuum nozzle is pressed against the floor to vacuum up debris. Still further, it would be advantageous to have an apparatus that collects the debris in a collection chamber present in the broom head or housing with a quick release door to empty the debris. Therefore, there currently exists a need in the market for an integrated cleaning and vacuum collection system that eliminates the need for a dust pan or that can pick up debris left on the floor after sweeping or after using a microfiber cleaner that leaves larger particles on the ground after cleaning.

The apparatus disclosed herein advantageously fulfills the aforementioned deficiencies by providing a broom-style apparatus with a built-in vacuum accessory, which provides a broom apparatus that does not require a dustpan.

In one example embodiment, the apparatus disclosed herein can have a broom-type configuration including a 14,000 RPM vacuum assembly with motor and impeller, a press-activating or actuating elongate nozzle member and a debris collector. The vacuum feature turns on when an articulating nozzle is dragged sideways along a line of debris via a momentary switch that is in contact with the articulating nozzle. In this example embodiment, the broom-style apparatus is battery operated and is operational for up to two years on the same set of 4 AA batteries. The apparatus has an air passage way that leads into a high capacity debris collector. The apparatus fulfills the need for a properly working broom with vacuuming ability to collect all debris that is swept up.

In one example embodiment, there is provided a cleaning apparatus including a housing enclosing a vacuum assembly, a debris collector, and a power source. The cleaning apparatus also includes a broom portion coupled to the housing and including a cleaning member, the cleaning member adapted to be in a first use position for contacting a surface to be cleaned. Further included is a nozzle member, in some embodiments an elongate member, which is coupled to the housing and is in a non-use position of not contacting the surface to be cleaned, wherein the vacuum assembly is fluidly connected to the nozzle member. There is also included an activating or actuating member operatively connected to the nozzle member at an end adjacent the housing, wherein the activating member activates the vacuum assembly with the power source when the nozzle is in a use position of contacting the surface being cleaned. The cleaning device also includes an elongate handle coupled to a portion of the housing.

In another example embodiment, there is provided a vacuum-assisted cleaning apparatus including a housing with a selectively actuable suction mechanism powered by a power source and a collection member enclosed therein. There is also a broom portion attached to the housing and including a cleaning member, the cleaning member being in a first use position for contacting a surface to be cleaned. The cleaning device also includes a nozzle member in fluid communication with the suction mechanism of the housing and extending from the housing, wherein the nozzle member selectively actuates or activates the suction mechanism.

In yet another example embodiment, there is provided a push broom-type cleaning apparatus including a housing enclosing a vacuum assembly, a debris collector, and a power source as well as a broom portion operatively coupled to the housing and including a cleaning member, the cleaning member being in a first use position for contacting a surface to be cleaned. The push broom-type cleaning apparatus with a nozzle member coupled to the housing and disposed in a non-use position of not contacting the surface to be cleaned, wherein the vacuum assembly is fluidly connected to the nozzle member. Further included is an activating or actuating member operatively connected to the nozzle member at an end adjacent the housing, wherein the activating member activates the vacuum assembly with the power source when the nozzle is in a use position of contacting the surface being cleaned. The push broom device includes an elongate handle coupled to a portion of the housing in a push broom configuration.

Among other things, it is an advantage of the disclosed apparatus to provide a broom with built in vacuum assembly to eliminate the need for a dustpan that does not suffer from any of the problems or deficiencies associated with prior solutions. It is still further an advantage of the invention to have a clear transparent elongate nozzle member so the user can see if there is a blockage. Still further, in this example embodiment the apparatus has a quick release door to empty the debris from the debris collector. The door can also be transparent to allow for easy visual indication of when the contents need to be emptied.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
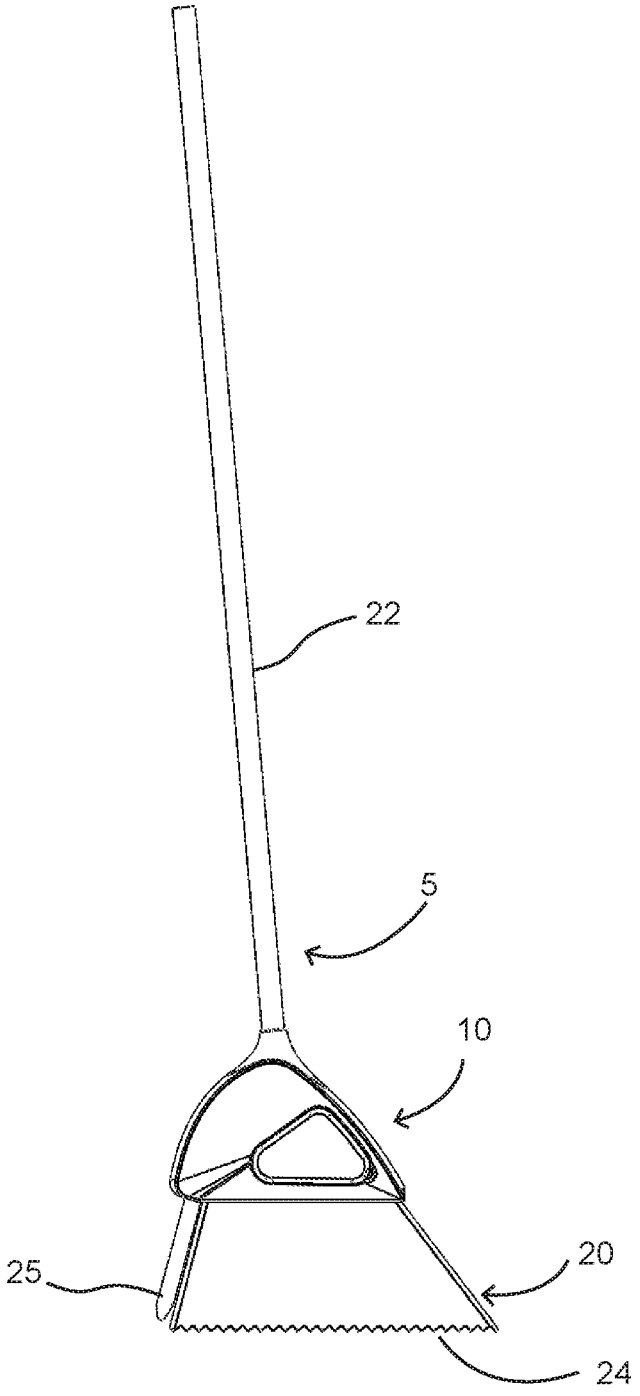
FIGS. 1, 3 and 12 are front, enlarged cutaway front and exploded perspective views of a broom-style cleaning apparatus according to the teachings herein.

Following are more detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

Referring to the Figures, FIGS. 1-5 and 10-12 illustrate an example embodiment of a house broom assembly 5 having a housing 10 and a broom portion 20. The housing 10 includes a vacuum assembly 30, a power source 40 and a debris collector 50. The broom portion 20 includes a cleaning member 24 (e.g. bristles). The broom portion 20 can be attached to the housing 10, the cleaning member 24 adapted to be in a first use position for contacting a surface to be cleaned.

In this example embodiment, a handle or pole 22 is connected at an upper portion of housing 10. The broom's cleaning member 24 is left to their natural state—uninhibited, and unaltered, for maximum sweeping performance and usability. A specifically concentrated diameter elongate intake nozzle 25 that vacuums up the debris on the floor is located adjacent bristles 24. To clean the floor, a user simply sweeps the debris into a line and then vacuums up the line of dirt or debris with nozzle 25 located on one side edge of the set of cleaning member 24. Vacuum assembly 30 is activated by tipping the broom portion 20 at an angle towards nozzle 25 and dragging it on the rear bristle edge as the user holds an ON switch 27 (or microswitch), by lowering or angling the small diameter intake nozzle 25 into close proximity with the debris line on the floor. The ON switch 27 can be located in any suitable location within or about the housing of the broom. In some embodiments, the ON switch 27 can be on the handle or pole and can wirelessly (such as Bluetooth®) or electrically activate the power source. In other embodiments, the nozzle is articulated to actuate the power source.

The housing 10 which includes the vacuum assembly 30 further can include a debris collector 50 in the housing 10. In some embodiments, the debris collector 50 can be one of a collection chamber (or collection canister), a disposable collection bag, or both a collection chamber and disposable collection bag. The vacuum assembly 30 can also include a release or debris collection door 38 to empty the debris from the debris collector 50.

Figure 3:
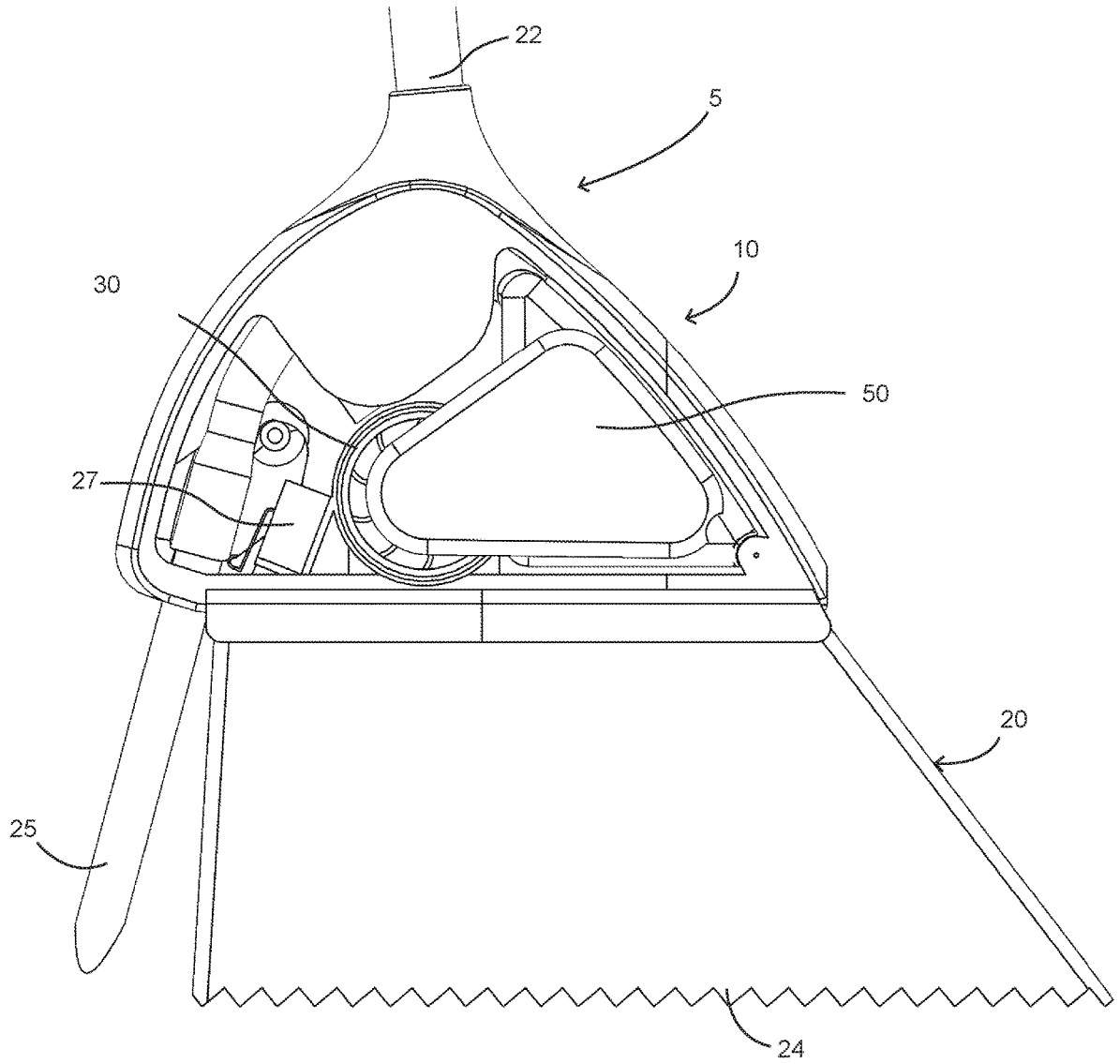
Figure 12:
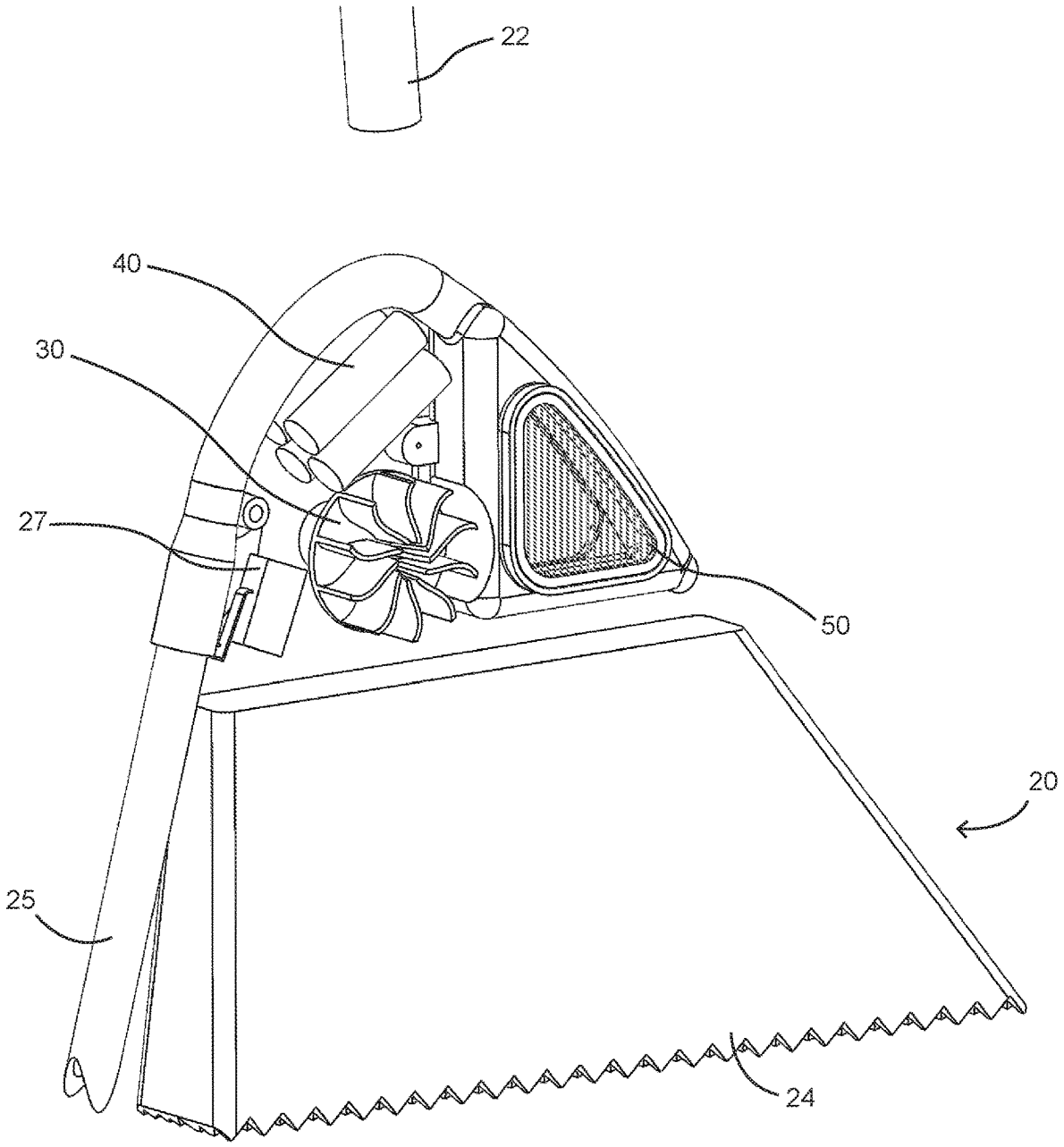
Figure 13:
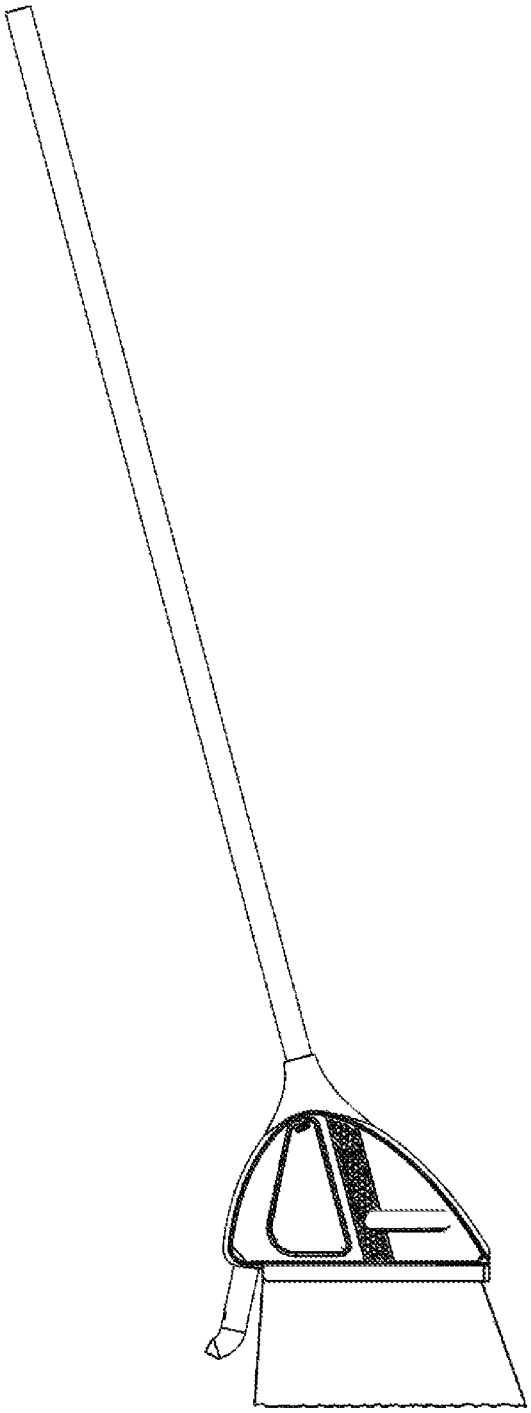
FIGS. 13-18 are front, rear, right and left side perspective, bottom and top views of another embodiment of a broom-style cleaning apparatus according to the teachings herein.
Figure 14:
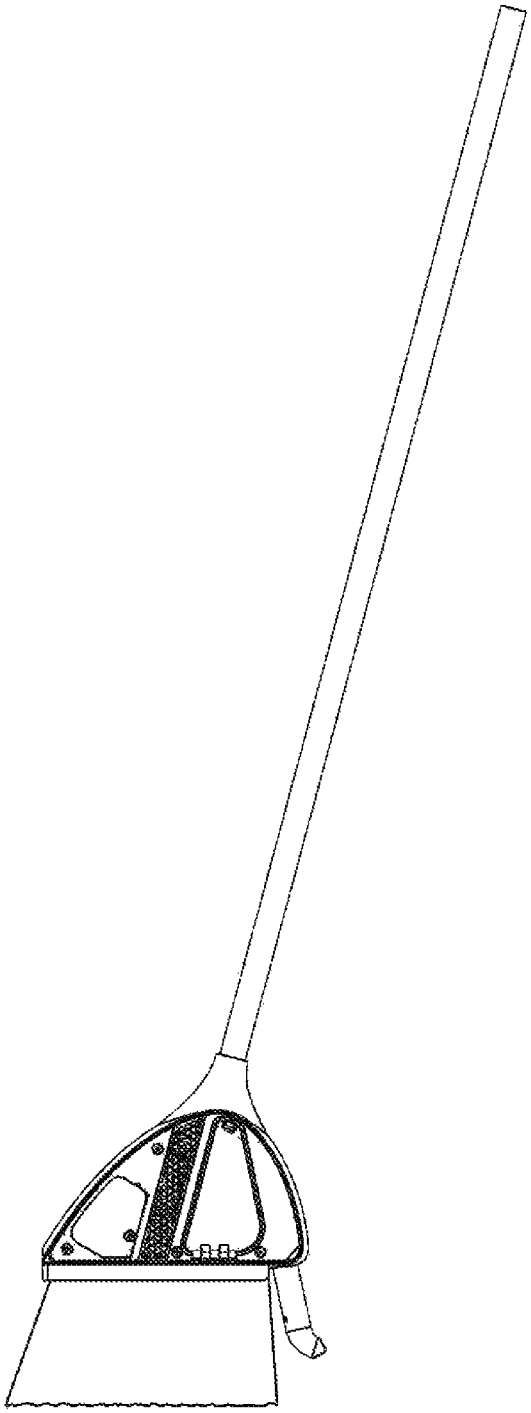
Figure 15:
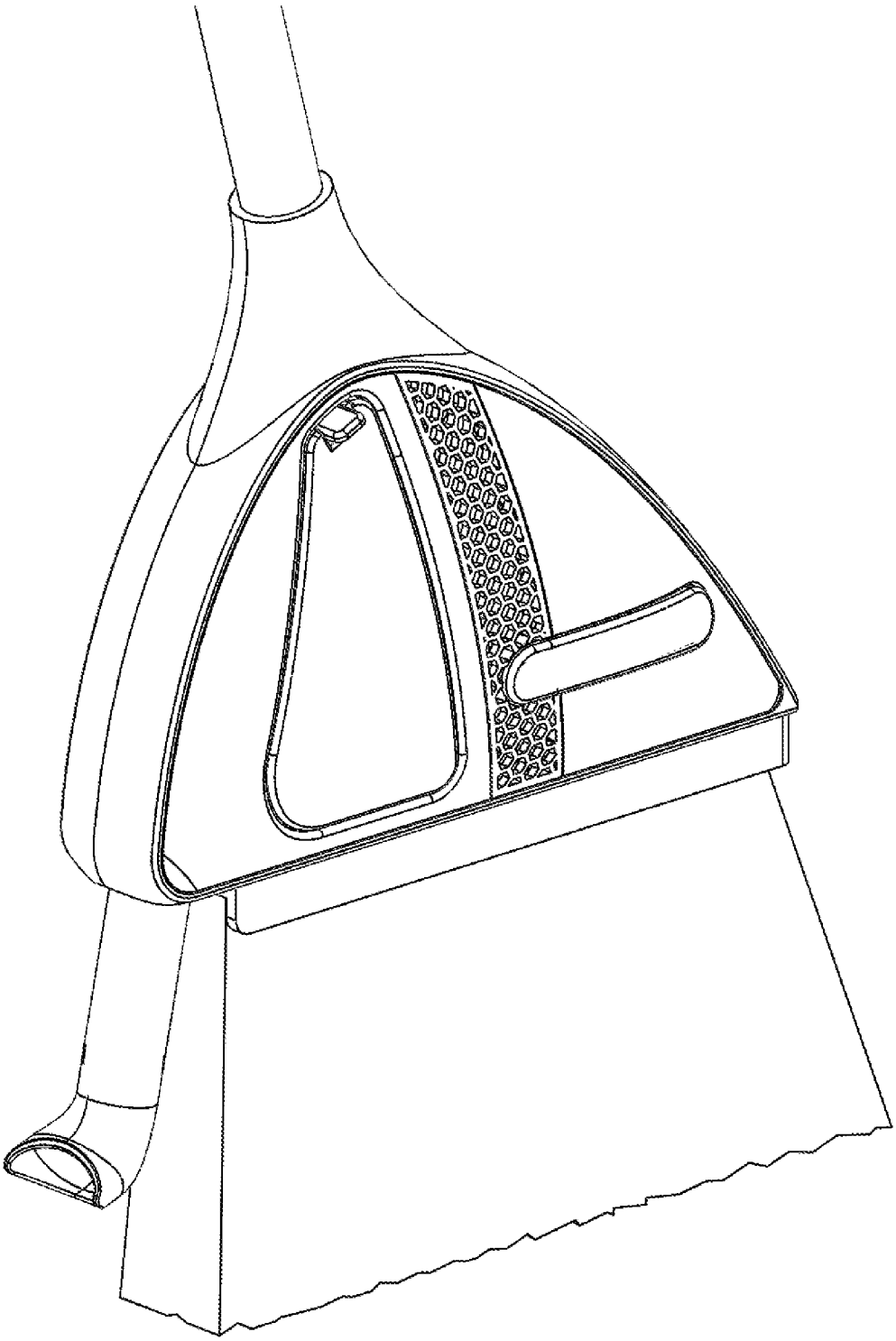
Figure 16:
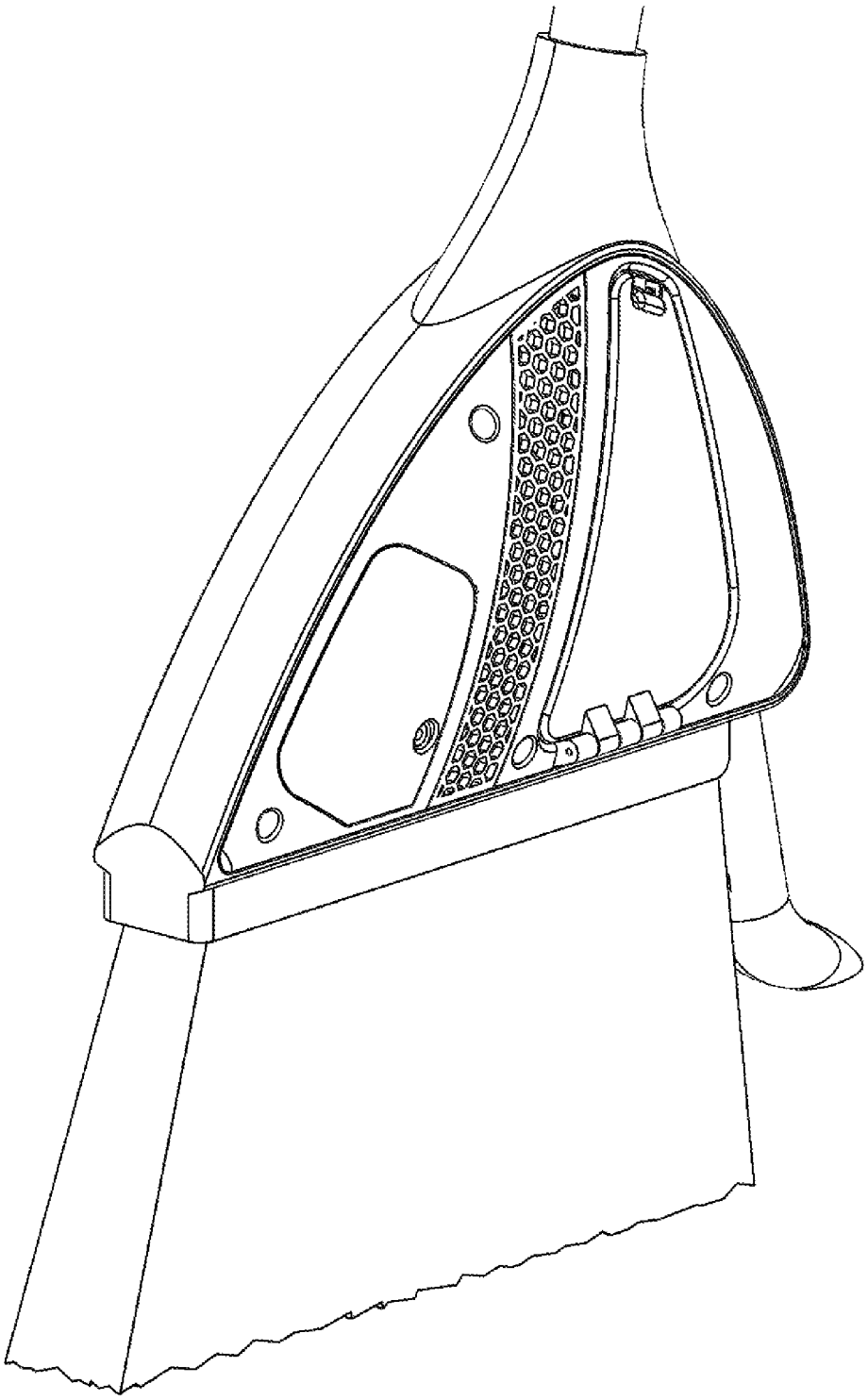
Figure 17:
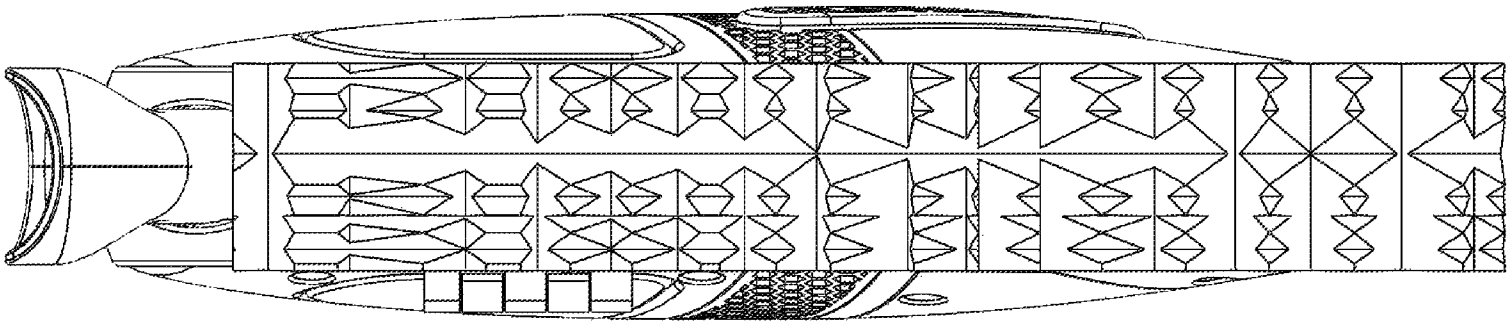
Figure 18:
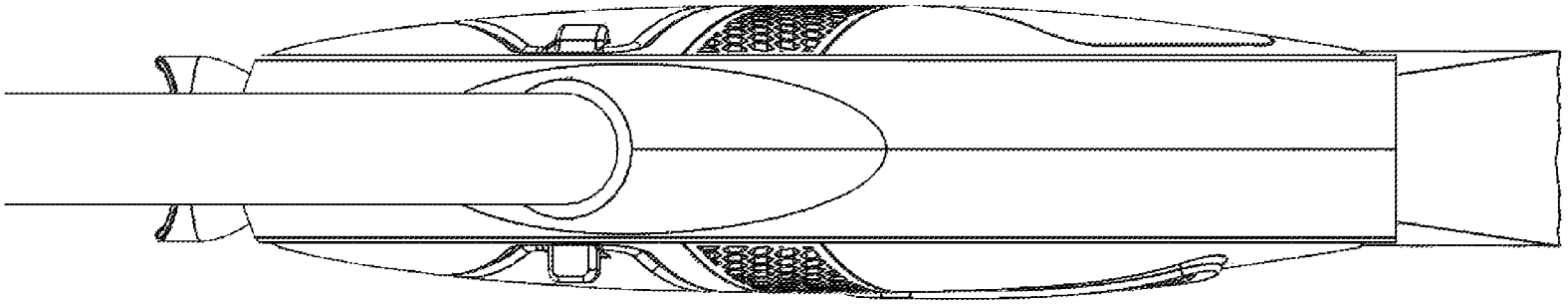

Referring to FIGS. 3 and 12, for example, also housed within the housing 10 is a power source 40. In various embodiments, the power source is one or more batteries. In other embodiments, the power source 40 can be one of a DC battery, rechargeable batteries, a solar strip and battery assembly, or an electric AC motor with an AC power cord. The battery assembly can include a charging port (e.g. USB), and charging indicator (LED or LCD).

Figure 2:
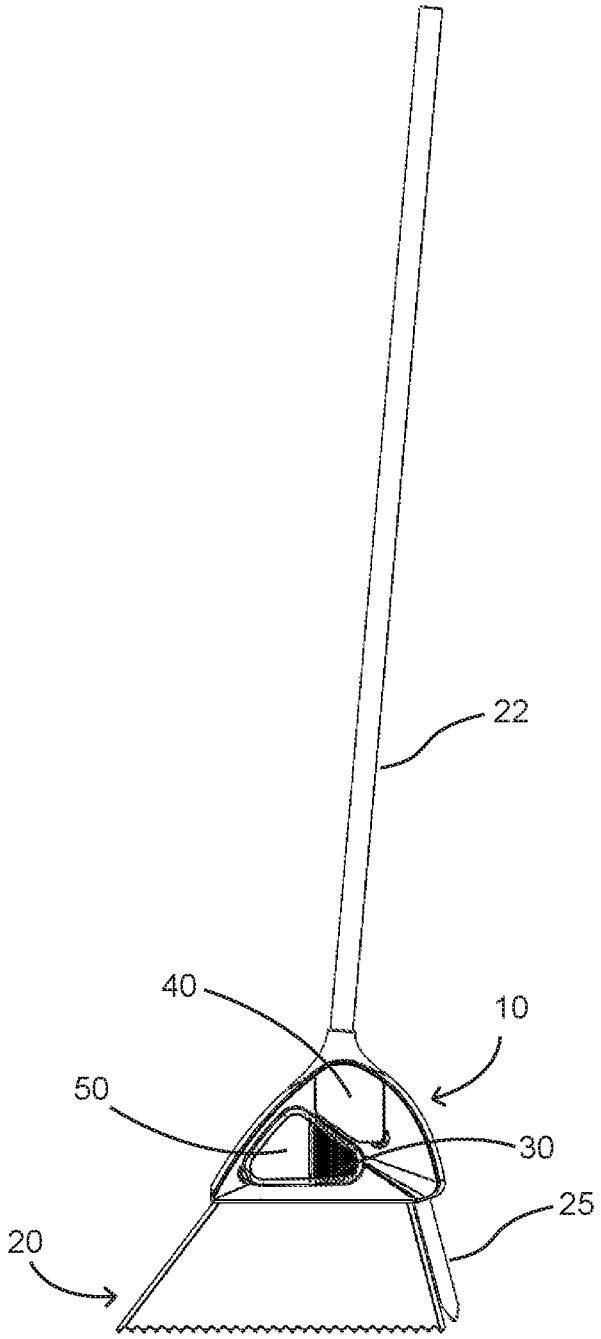
FIGS. 2 and 4 are rear and enlarged cutaway rear views of the broom-style cleaning apparatus according to the teachings herein.
Figure 4:
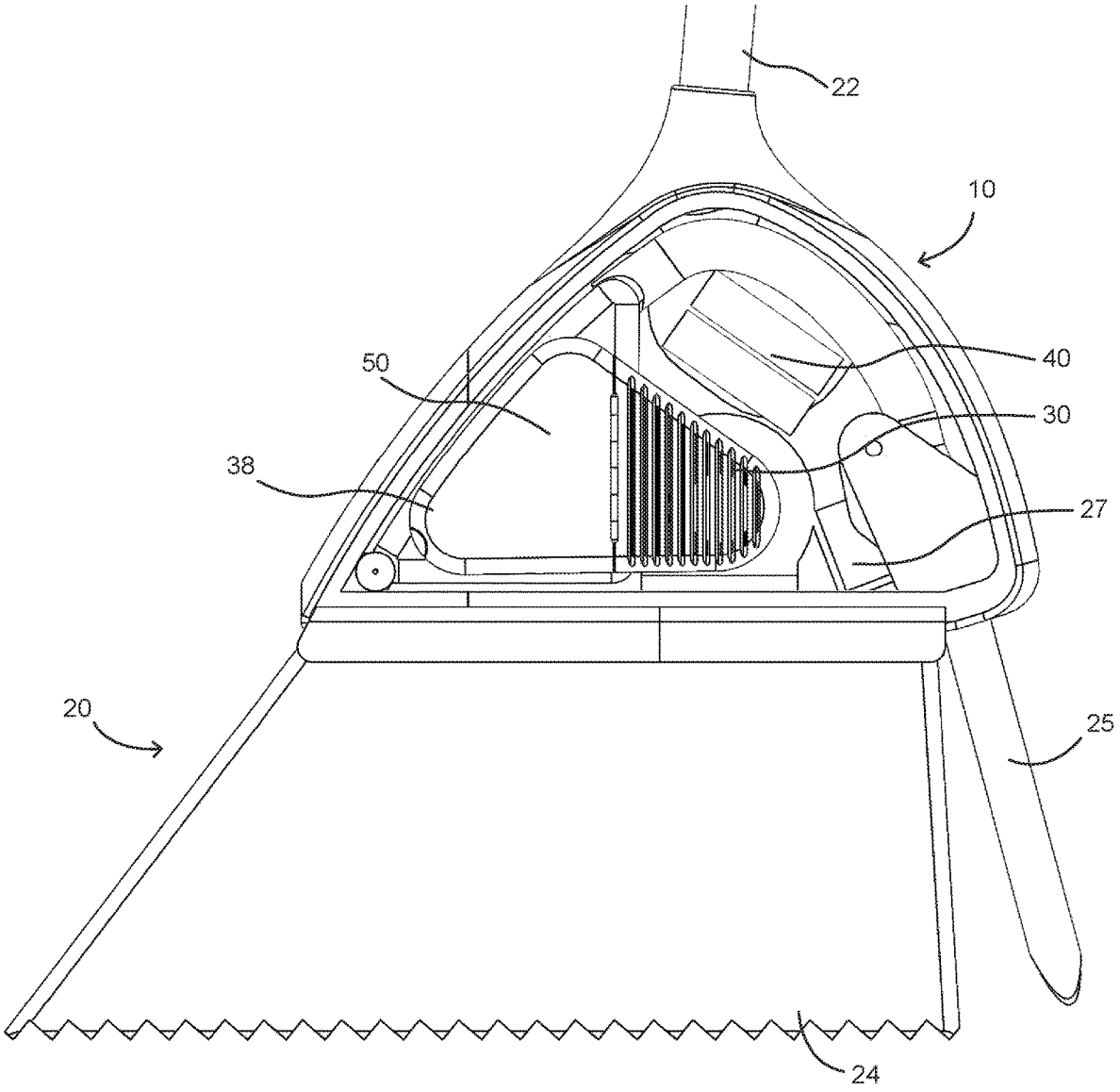

FIGS. 1 and 2 illustrate the front and rear views of the apparatus while FIGS. 3 and 4 illustrate a cutaway views of the apparatus showing the broom assembly 5, housing 10 with the nozzle 25 at one end of the bristles 24. The nozzle member 25 is in fluid communication with the housing 10 that includes the vacuum assembly 30 with motor and impeller or vacuum device or module. Referring to FIG. 4, which illustrates the broom with at one end of the bundle of bristles including a nozzle 25. The nozzle 25, in this example embodiment, is in fluid communication with the housing of the broom such that it transfers the debris into a collection chamber. The nozzle can be transparent or translucent, providing the convenience of monitoring potential blockages. In one example embodiment, a portion of housing includes a magnetic prong to facilitate picking up metal objects such as bobbie pins or paper clips. FIG. 4 also illustrates the power source 40 in the housing 10 along with a debris collector 50. In some embodiments, the debris collector 50 can include a filter. In this example embodiment, nozzle 25 is selectively actuatable such that the nozzle is in fluid communication with the suction or vacuum in the housing.

Figure 9:
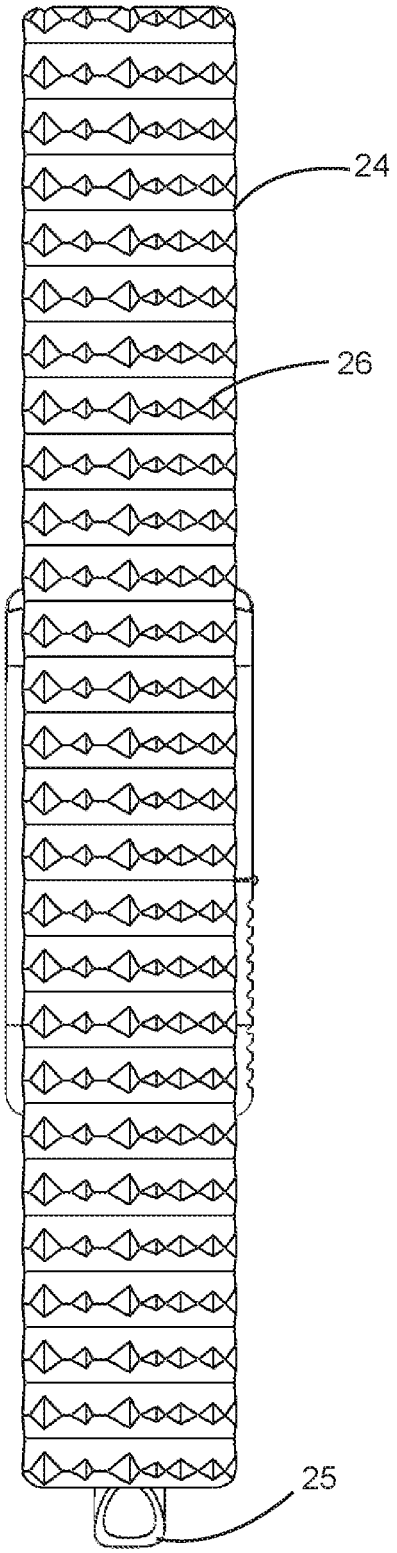
FIG. 9 is the bottom view of the cleaning member for the broom-style cleaning apparatus according to the teachings herein.
Figure 10:
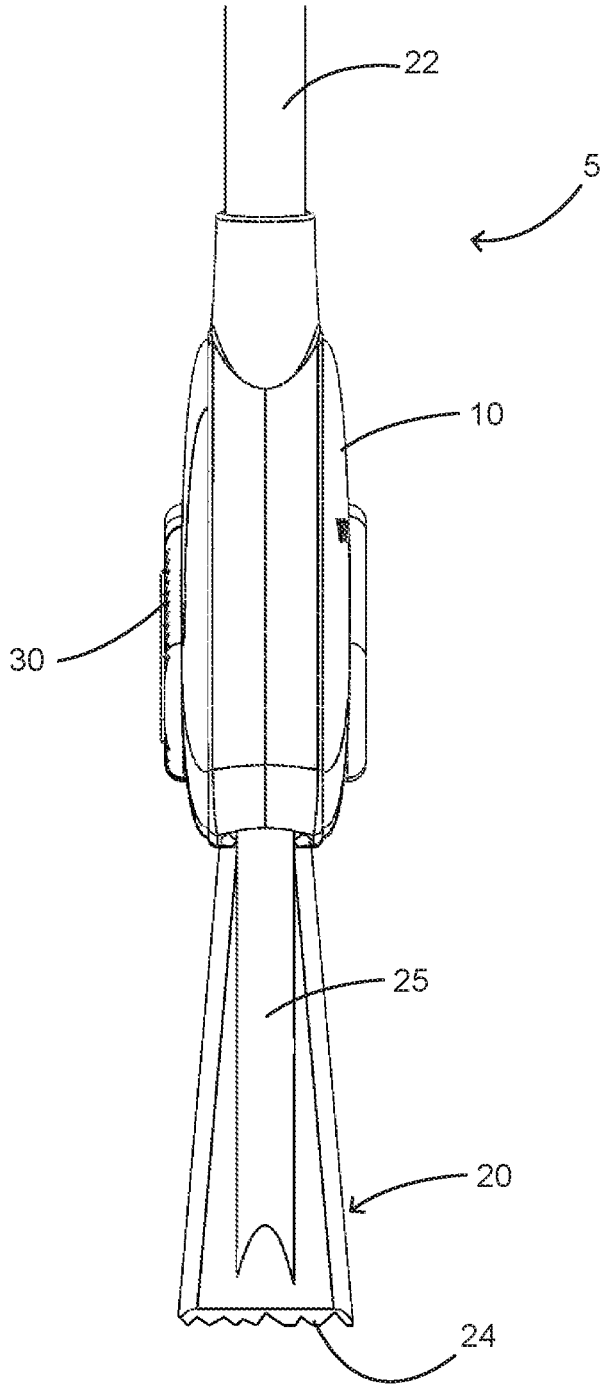
FIGS. 10 and 11 are enlarged side and top rear views of a broom-style cleaning apparatus according to the teachings herein.
Figure 11:
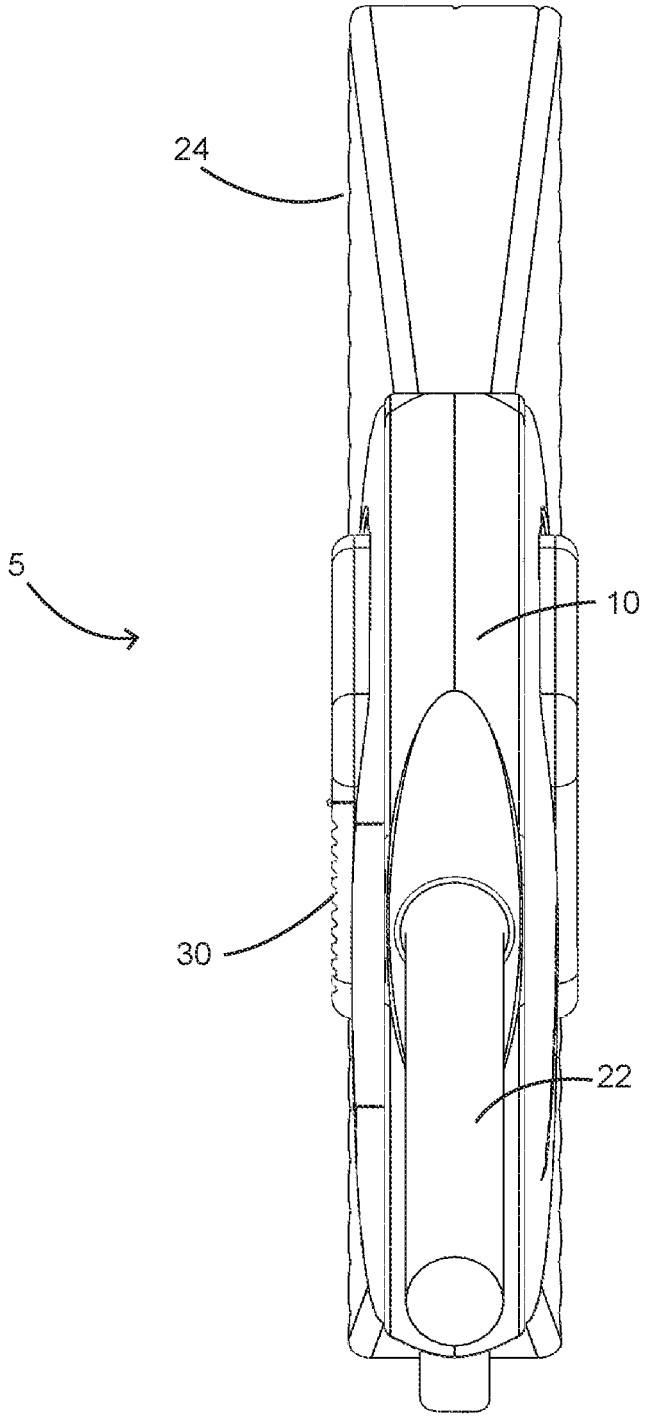

FIGS. 1-5 and 12 also show the nozzle at one end of the bristles. In some embodiments, the cleaning member 24 can be selected from a group of a set of bristles, a sponge-like member, a microfiber cloth, and a disposable microfiber cloth or microfiber paper cloth. FIGS. 9 and 12 illustrate embodiments of bristles 26 that have conical or pyramidal configurations to enhance sweeping of the surfaces to be cleaned.

Figure 5:
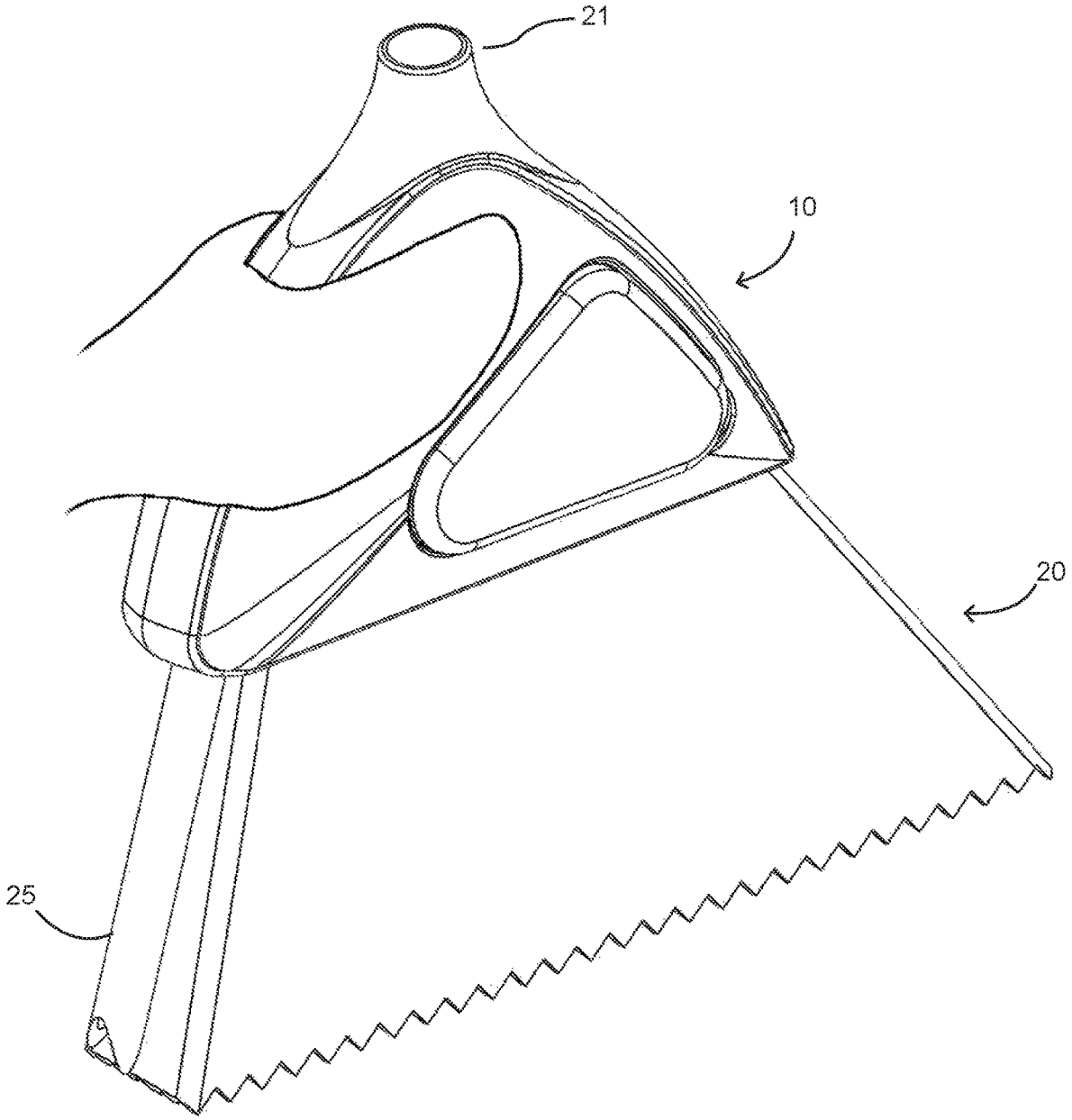
FIG. 5 is a side perspective view of a head portion only of a vacuum assisted cleaning device according to an embodiment of the invention.

As illustrated in FIG. 5, in this example embodiment, a broom handle device 21 can have handle 22 be removably detached from housing 10 such that only housing 10 and vacuum assembly 30 are used as a handheld sweep/vacuum device for sweeping and vacuuming up workshops or benchtops, and the like.

In a related embodiment, handle 22 is attachable to housing 10 using known mechanical/frictional/screw-on, magnetic or combination of mechanical or magnetic members to attach and detach the handle from the broom housing.

Figure 6:
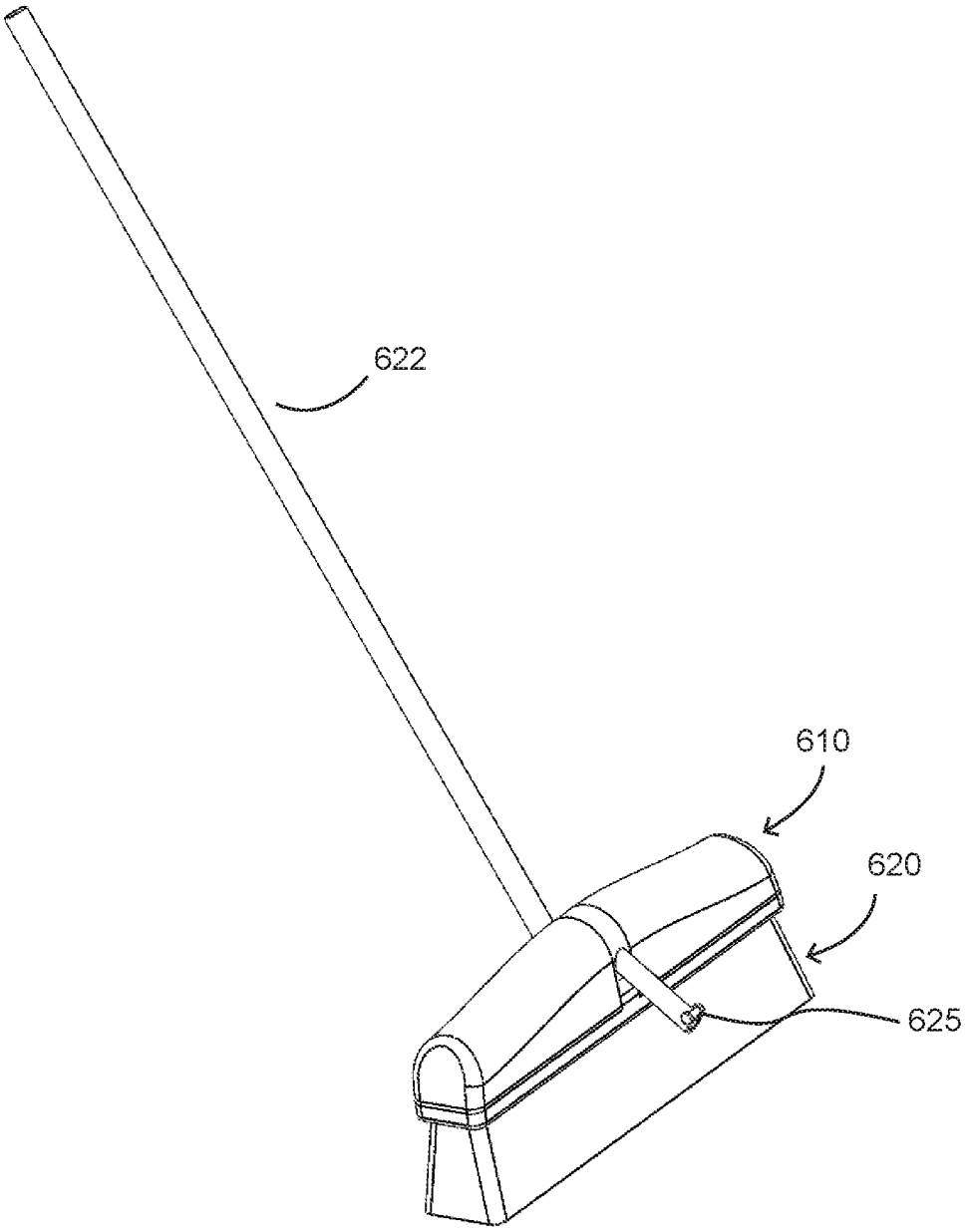
FIGS. 6 and 7 are front and rear perspective views of a push broom-style cleaning apparatus according to the teachings herein.
Figure 7:
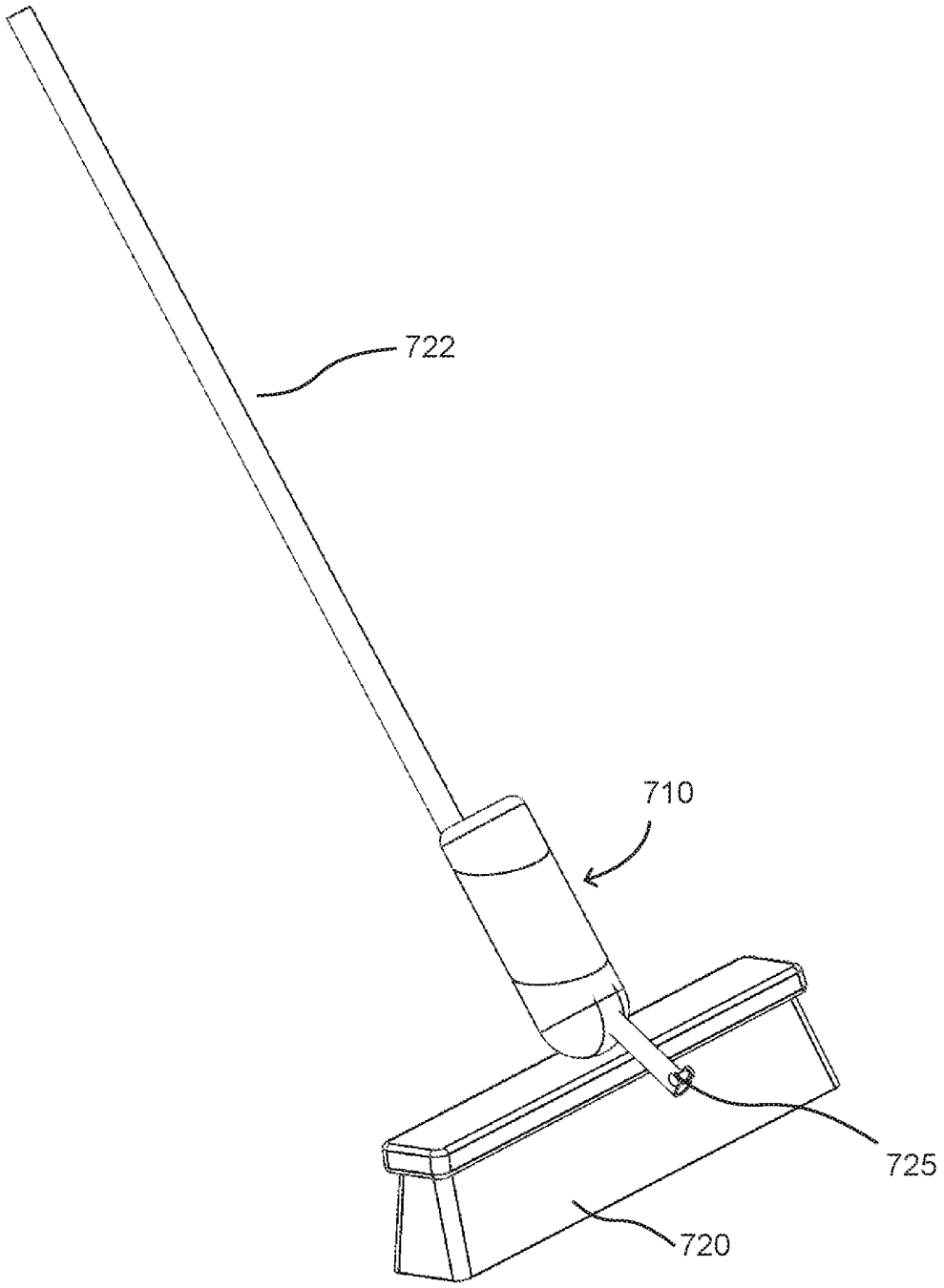
Figure 8:
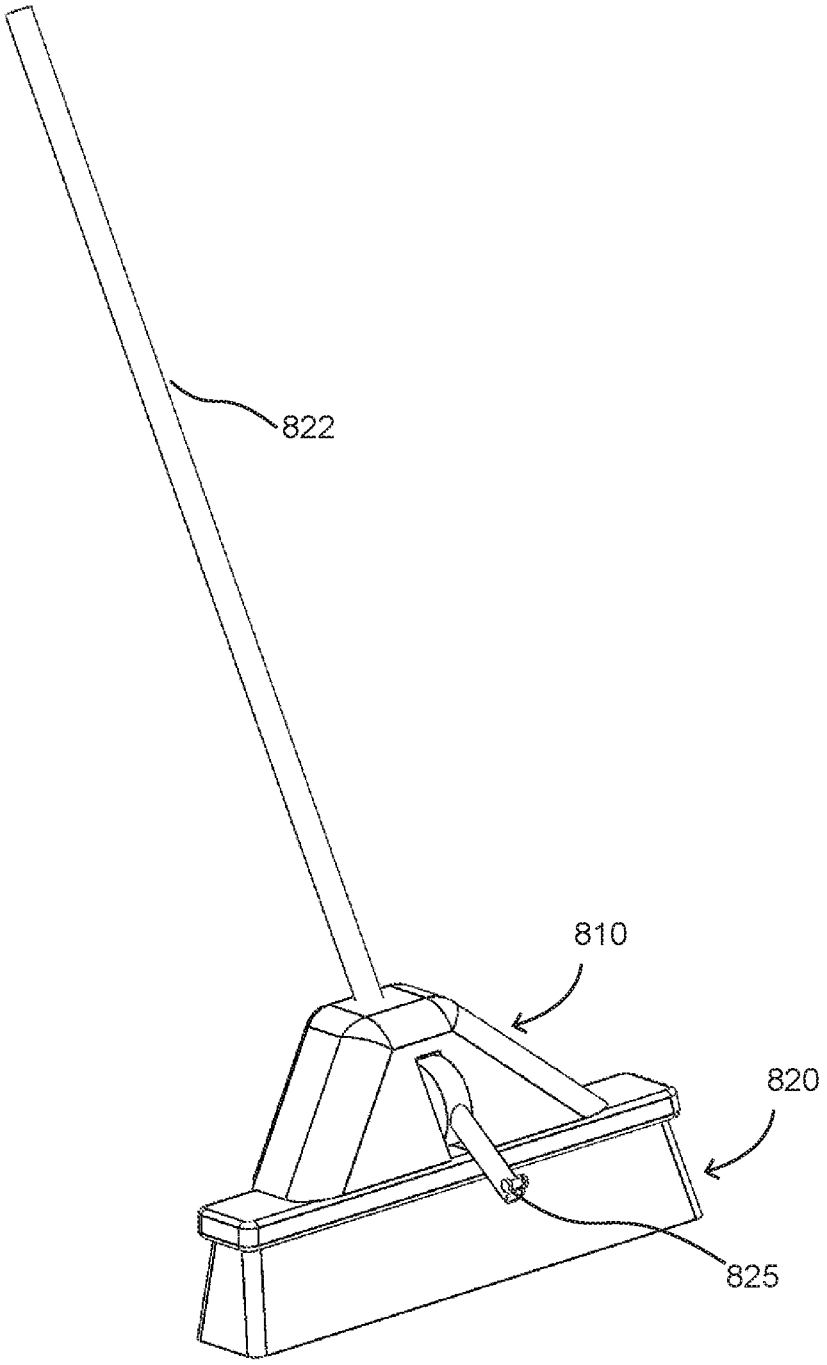
FIG. 8 is a perspective view of another embodiment of a push broom-style cleaning apparatus according to the teachings herein.

Referring to FIGS. 6-7 and 8, different embodiments of a pushbroom assembly are illustrated. For example, FIGS. 6-7 and 8 illustrate broom assemblies having elongate handles 622, 722 and 822 having a push broom-style configuration wherein each of nozzles 625, 725 and 825 that are adjacent to and protrude or extend from the housing. In some embodiments, the various nozzles protrude from body 610, body 710 and body 810 and are coplanar with the pushbroom-style handles 622, 722 and 822, respectively.

Referring now to FIGS. 13-18, there is illustrated front, rear, right and left side perspective, bottom and top views of another embodiment of a broom-style cleaning apparatus according to the teachings herein.

The following patents are incorporated by reference in their entireties: U.S. Pat. Nos. 6,029,311 and 7,673,371.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

The invention claimed is:

1. A cleaning apparatus comprising:

a housing enclosing a vacuum assembly, a debris collector, and a power source;

a broom portion fixedly coupled to the housing and including a cleaning member, the cleaning member adapted to be in a first use position of contacting a surface to be cleaned;

an elongate nozzle member pivotally connected to and extending out from the housing and adapted to be in a non-use position of not contacting the surface to be cleaned when the cleaning member is in the first use position, wherein the vacuum assembly is fluidly connected to the nozzle member at one end adjacent the housing, and wherein the elongate nozzle member is an actuating nozzle member;

an activating member operatively connected to the actuating nozzle member at a proximal end adjacent the housing, wherein the activating member is adapted to activate the vacuum assembly with the power source by tipping the broom portion at an angle towards the actuating nozzle member and pressing a distal end of actuating nozzle member against the surface to be cleaned to pivot the actuating nozzle portion relative to the broom portion into a use and activating position; and an elongate handle coupled to a portion of the housing.

2. The cleaning apparatus of claim 1, wherein the handle is removably attached or coupled to the housing.

3. The cleaning apparatus of claim 1, wherein the cleaning member is selected from a group consisting of a set of bristles, a sponge-like member, a microfiber cloth, and a disposable microfiber paper cloth.

4. The cleaning apparatus of claim 1, wherein the debris collector in the housing comprises one of a collection chamber, a disposable collection bag, or both a collection chamber and a disposable collection bag.

5. The cleaning apparatus of claim 4, wherein the housing further comprises a door moveable between an open and a closed position and adjacent the debris collector.

6. The cleaning apparatus of claim 4, wherein the debris collector further comprises a removable canister.

7. The cleaning apparatus of claim 1, wherein the power source is one of a DC battery, a solar strip and battery assembly and an electric AC motor with an AC power cord.

8. The cleaning apparatus of claim 1, wherein the activating member is a microswitch located within the housing and configured to be in contact with the actuating nozzle member.

9. The cleaning apparatus of claim 1, wherein a portion of the housing includes a magnetic prong or member adapted to pick up metal objects.

* * * * *